US005119957A

United States Patent [19]

Joyce-Middaugh

[11] Patent Number: 5,119,957

[45] Date of Patent: Jun. 9, 1992

[54] TRASH RECEPTACLE DIVIDER

[76] Inventor: Victoria Joyce-Middaugh, R.D. 2 Ketchner Rd., Wellsville, N.Y. 14895

[21] Appl. No.: 678,796

[22] Filed: Apr. 1, 1991

[51] Int. Cl.[5] ..... B65D 1/24

[52] U.S. Cl. ..... 220/404; 220/909

[58] Field of Search ..... 220/529, 909, 404

[56] References Cited

U.S. PATENT DOCUMENTS

| | | | |
|---|---|---|---|
| 3,385,465 | 5/1968 | Bliss | 220/23.4 |
| 3,720,346 | 3/1973 | Cypher | 220/22.3 |
| 3,893,615 | 7/1975 | Johnson | 220/404 |
| 3,904,218 | 9/1975 | Kostic | 280/79.2 |
| 4,750,638 | 6/1988 | Sosower | 220/404 |
| 4,834,262 | 5/1989 | Reed | 220/404 |
| 4,867,328 | 9/1989 | McCarthy | 220/1 T |
| 4,905,853 | 3/1990 | Strander | 220/404 |
| 4,967,900 | 11/1990 | Gossett | 220/404 |
| 5,005,727 | 4/1991 | Roth | 220/404 |

*Primary Examiner*—Joseph Man-Fu Moy
*Attorney, Agent, or Firm*—Head & Johnson

[57] ABSTRACT

To divide a substantially rigid trash receptacle into a plurality of compartments defined by a plurality of disposable trash can liners, a peripheral support member rests on top of and interiorly abuts the rim of the receptacle. A plurality of dividing members extend radially between the center of the support member and one of a plurality of connecting points spaced along the support member. A plurality of fastener arms are nestlable in corresponding dividing members so that portions of the mouths of two adjacent liners can be sandwiched between each pair of arms and dividing members. Preferably, one end of each of the arms is hinged for rotation of the arm into its respective dividing member. A releasable lock may also be provided for securing each arm within its respective dividing member. A portion of the mouths of each of the liners can also be sandwiched between the peripheral member and the rim. Each adjacent pair of dividing members cooperates with its arms and that portion of the support member between the pair cooperates with the receptacle rim to secure the mouth of one of the liners. The liners in turn divide the receptacle into a plurality of compartments. The support member fits within the receptacle cover so that the receptacle can be closed in normal fashion.

16 Claims, 2 Drawing Sheets

TRASH RECEPTACLE DIVIDER

BACKGROUND OF THE INVENTION

This invention relates generally to trash receptacles and more specifically concerns apparatus for dividing a trash receptacle into compartments suitable for separation of classes of recyclable trash.

Most known trash receptacle dividers incorporate rigid panels that extend for the full length of the trash receptacle. Disposable liners are inserted in each of the compartments defined by the panels. As a result, when any one compartment is full, the receptacle can no longer be used to receive and separate the class of trash intended for that compartment, even though one or more of the other compartments may be partially or totally empty. Consequently, the full capacity of the receptacle can not be used without more frequent servicing of the receptacle than otherwise necessary.

One divider has been developed which splits the mouth of a receptacle diametrically. A plurality of hooks disposed around the perimeter of the receptacle and on the diagonal divider support two disposable trash can liners within the receptacle. While this divider does not use the full length panels that limit the use of the receptacle capacity, the hooks tear the liners rather easily. This destroys the compartment relationship and defeats the purpose of the device.

It is, therefore, an object of the present invention to provide a trash receptacle divider that facilitates maximum use of the full capacity of the receptacle regardless of the capacity used in any one or more compartments of the receptacle. It is a further object of this invention to provide a trash receptacle divider that reduces the possibility of damage to the disposable liners and separation of the liners from the divider. Another object of the invention is to provide a trash receptacle divider for dividing existing trash receptacles into multiple compartments without use of any tools on or modification to the existing receptacle.

SUMMARY OF THE INVENTION

In accordance with the invention apparatus is provided for use in dividing a substantially rigid trash receptacle into a plurality of compartments defined by a plurality of disposable trash can liners.

A peripheral support member rests on top of and interiorly abuts the rim of the receptacle. A plurality of dividing members, preferably of convex cross-section, extend radially between the center of the support member and one of a plurality of connecting points spaced along the support member. A plurality of fastener arms are nestlable in corresponding dividing members so that portions of the mouths of two adjacent liners can be sandwiched between each pair of arms and dividing members. Preferably, one end of each of the arms is hinged for rotation of the arm into its respective dividing member. A releasable lock may also be provided for securing each arm within its respective dividing member. A portion of the mouths of each of the liners can also be sandwiched between the peripheral support member and the rim. It can readily be seen that each adjacent pair of dividing members cooperates with its arms and that portion of the support member between the pair cooperates with the receptacle rim to secure the mouth of one of the liners. The liners in turn divide the receptacle into a plurality of compartments of variable volume depending on the capacity used in each compartment.

The support member fits within the receptacle cover so that the receptacle can be closed in normal fashion.

The dividing members preferably divide the receptacle mouth into quadrants, but other configurations are possible. The apparatus can be used with typical circular, rectangular, square or ovate receptacles available today.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 8:
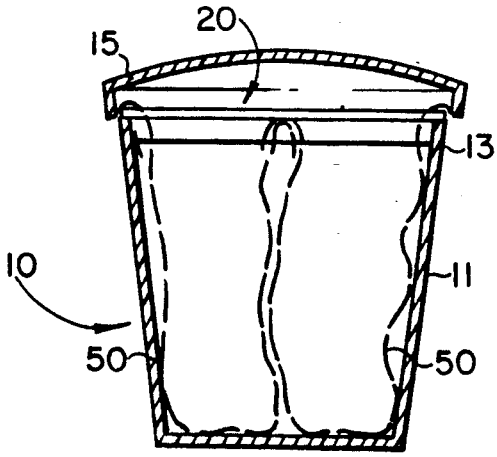
FIG. 8 is a cross-sectional view of a typical trash receptacle incorporating the divider of FIG. 1 with disposable liners in place.

In FIG. 8, a typical trash receptacle 10 is illustrated including a receptacle 11 having a mouth defined by a rim 13 and a removable cover 15. A receptacle divider 20 according to the present invention is shown seated on the rim 13 of the receptacle 11. The trash receptacle 10 and the divider 20 illustrated in FIG. 8 are of circular configuration. However, the divider herein disclosed can readily be configured for use with any square, rectangular, ovate or other receptacles presently available in the market place.

Figure 1:
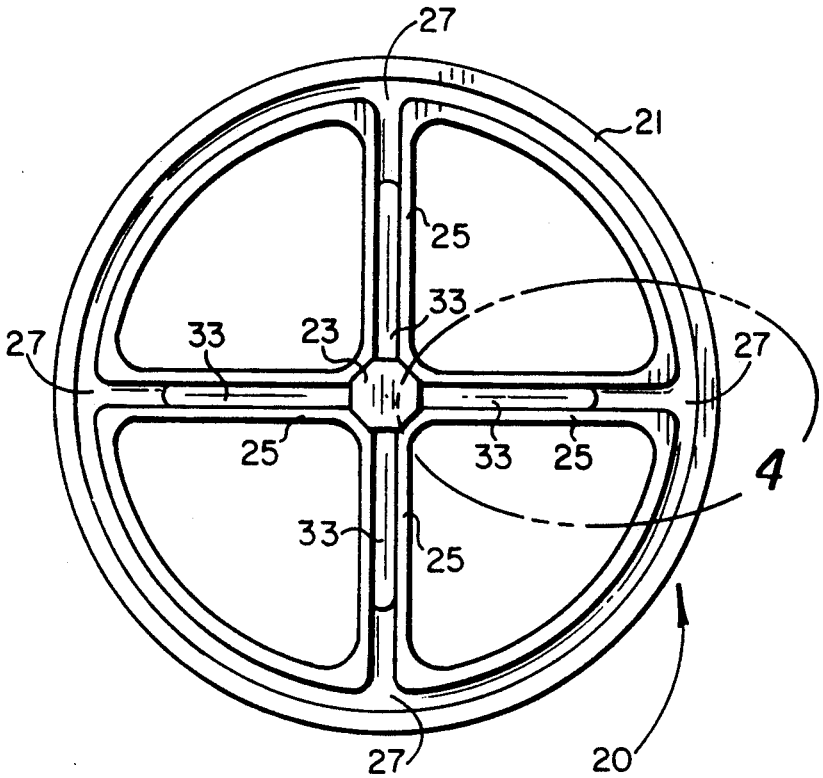
FIG. 1 is a top plan view of a preferred embodiment of the divider.
Figure 2:
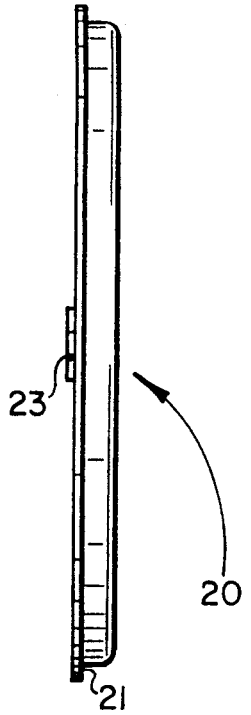
FIG. 2 is an end view of the divider of FIG. 1.
Figure 3:
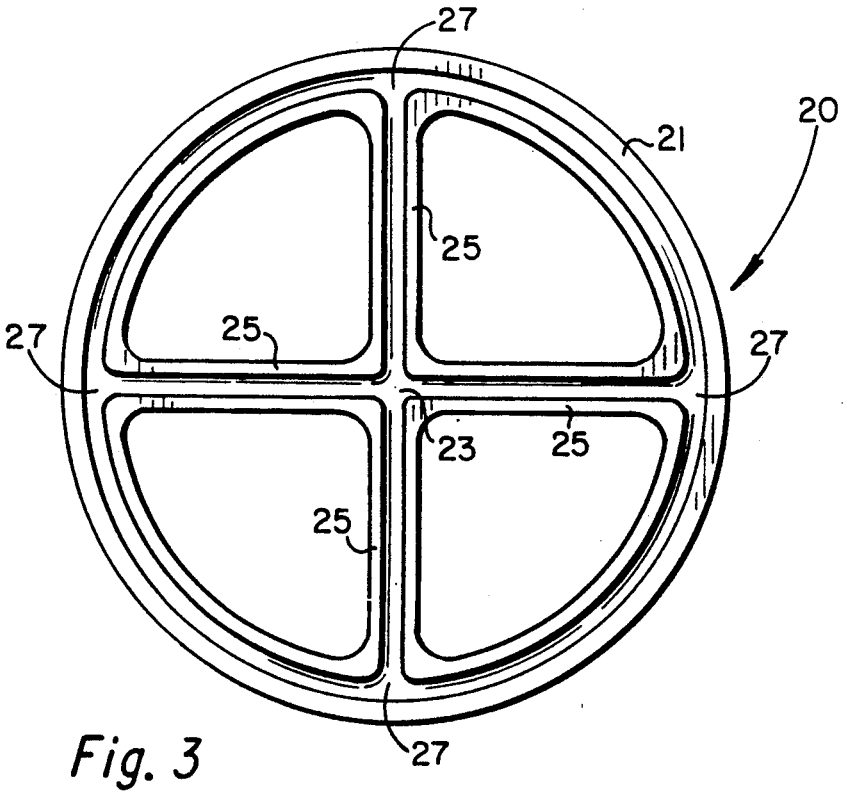
FIG. 3 is a bottom view of the divider of FIG. 1.

Turning to FIGS. 1, 2 and 3, the divider 20 shown in FIG. 8 is illustrated in more detail. It consists of a peripheral support member 21 configured so as to sit on the upper surface of the rim 13 of the receptacle 11. A plurality of dividing members 25 radially extend between a point of origin 25 proximate the center of the peripheral member 21 and a plurality of connecting points 27 spaced along the peripheral member 21. As shown, the dividing members 25 separate the divider 20 into quadrants, but any number of dividing members may be used to separate the divider 20 into a desirable number of sections at regular or irregular intervals along the peripheral member 21.

Figure 7:
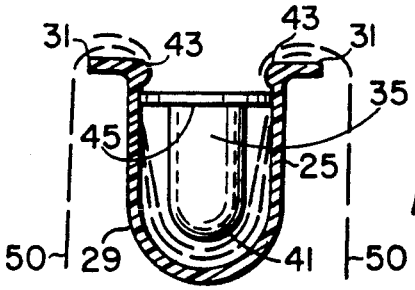
FIG. 7 is a cross-sectional view taken along the line 7—7 of FIG. 5 with two disposable liners sandwiches in place.

As can best be seen in FIG. 7, the dividing members 25 will preferably have a U-shaped cross-section with a concave inner surface 29 and flanges 31 at its upper edges. The peripheral support member 21 is preferably of similar U-shaped configuration with the exterior flange of the U-shaped member providing a lip 21 as shown in FIG. 4 to be seated on top of the rim 13 of the receptacle 11 and the exterior leg of the U-shaped cross-section providing a lip 21 as shown in FIG. 4 to be seated within the rim 13, thus securing the position of the peripheral member 21 on the rim 13 of the receptacle 11.

Returning to FIG. 1, the divider 20 also includes a plurality of fasteners 33, one associated with each of the dividing members 25. The fasteners 33 are seated on the dividing members 25 so that the opening edge of a typical trash can liner can be sandwiched between the fastener 33 and the dividing member 25 as will hereinafter be explained.

Figure 4:
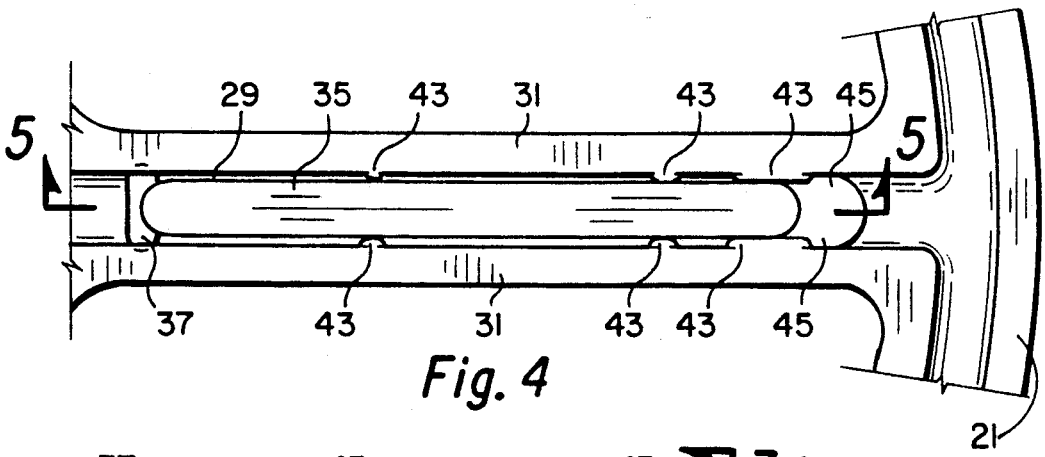
FIG. 4 is an enlarged top plan view of segment 4 of FIG. 1.
Figure 5:
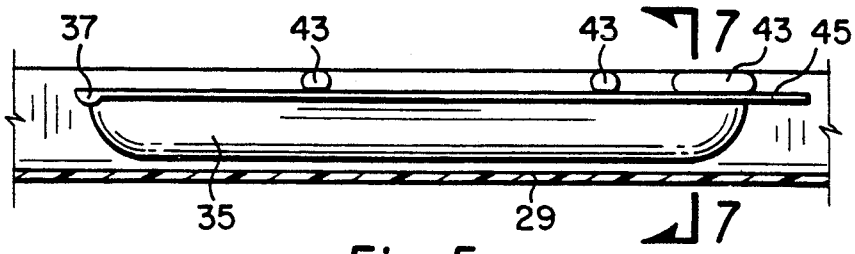
FIG. 5 is a cross-sectional view taken along the line 5—5 of FIG. 4.
Figure 6:
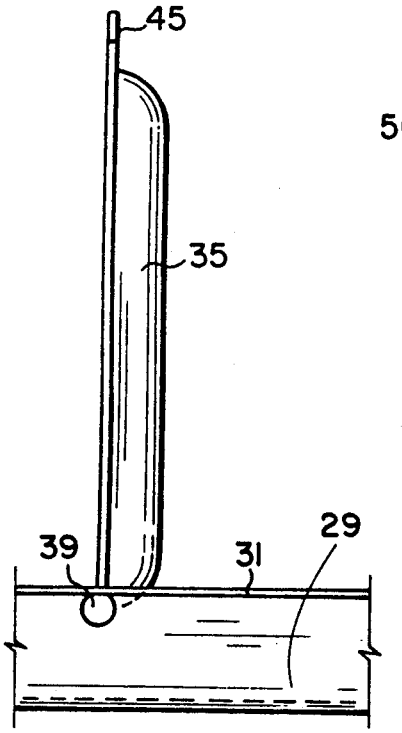
FIG. 6 is a partial elevational view illustrating an arm of the divider of FIG. 1 in an open condition.

In the preferred embodiment shown in more detail in FIGS. 4, 5 and 6, the preferred configuration and mounting of the fastener 33 to the dividing member 25 is illustrated. The fastener 33 consists of a fastener arm 35 which nestles in the concave portion 29 of the dividing member 25. One end of the arm 35 is provided with lugs 37 which are seated in dimples 39 on the inside walls of the concave surface 29 of the dividing member 25. Thus, the arm 35 is hinged for rotation upwardly out of the concave surface 29 of the dividing member 25 or downwardly to nestle into the concave surface 29. As can best be seen in FIG. 7, it is preferred that the arm 35 have a U-shaped outer configuration 41 adapted to be nestled within the concave surface 29.

In a particularly preferred embodiment as shown, the inside edges of the concave surface 29 of the dividing member 25 may be provided with one or more nodes or knurls 43 to help secure the arm 35 within its dividing member 25. Furthermore, one or more complementary flanges 45 may be provided on the arm 35 which will snap under the nodes or knurls 43 and lock the arm 35 in place until sufficient upward force is exerted on the arm 35 to withdraw it from the dividing member 25.

The operation of the divider 20 can best be understood in reference to FIGS. 6, 7 and 8. As shown in FIG. 8, the receptacle 11 will be divided into compartments by a plurality of trash can liners 50 with one such liner 50 being used with respect to each of the receptacle mouth sections defined by a pair of dividing members 25 and the segment of the peripheral member 21 between them. Thus, for the divider 20 illustrated herein, four liners 50 would be employed. The divider 20 is inserted into the mouth of the receptacle 11 with the lip 21 seated on the top of the receptacle rim 13 and the outer leg of the U-shaped portion of the peripheral member 21 disposed along the inside surface of the rim 13 to hold the divider 20 in place on the receptacle 11. The fastener arms 35 are then moved to the open position as shown in FIG. 6. A trash can liner 50 can then be inserted into each of the sections defined by the divider 20 with a first portion of the opening edge of the liner 50 overlapping one of the dividing members 25, a second portion of the opening edge of the liner 50 overlapping an adjacent dividing member 25 and a third portion of the opening edge of the liner 50 overlapping the section of the peripheral member 21 between those two dividing members 25. With each of the liners 50 thus placed, the fastener arms 35 can be rotated to the closed position as shown in FIG. 7 so that the opening edges of the two liners 50 will be sandwiched between the concave surface 29 of the dividing member 25 and the fastener arm 35. The flange 45 will snap under the knurl 43 to lock the arm 35 in position and secure the liners 50 in relation to the dividing members 25. The divider 20 may then be slightly lifted from the receptacle 11 and the third portion of each of the liners 50 wrapped around the peripheral member 21 and inserted into the inside surface of the rim 13 of the receptacle 11 to complete the securing of each of the liners 50 within the receptacle 11, as best seen in FIG. 8. Since there are no dividing panels within the receptacle 11, if the volume of the liners 50 is selected so that their total volume is greater than the volume of the receptacle 11, it will be seen that the capacity of the receptacle can be fully used without having a predetermined ratio of volumes in any of the compartments.

Since the peripheral member 21 rests upon the rim 13, the divider 20 does not interfere with the normal use of the cover 15 on the receptacle 11, as is seen in FIG. 8.

Preferably, the divider 20 will be molded in an integral plastic configuration, though other materials and means of construction may be employed.

Thus, it is apparent that there has been provided, in accordance with the invention, a trash receptacle divider that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. For use in dividing a substantially rigid trash receptacle having a topwardly accessible mouth defined by a rim of the receptacle into a plurality of compartments defined by a plurality of disposable trash can liners, apparatus comprising:

a peripheral support member adapted to be seated on the rim of the receptacle with a first portion of an opening edge of each of the liners overlapping said support member and sandwiched between said support member and said rim;

a plurality of dividing members, each extending radially between an origin proximate a center of said support member and one of a plurality of connecting points spaced along said support member; and a plurality of elongated fastener arms, each adapted to be seated within a respective one of said dividing members with a second portion of an opening edge of one of the liners and a third portion of an opening edge of another of the liners sandwiched therebetween; and means for securing each of said arms within its respective dividing member, whereby each adjacent pair of dividing members and a portion of said support member therebetween cooperate in securing an opening edge of one of the liners and to define a compartment mouth for each of the plurality of compartments.

2. Apparatus according to claim 1 further comprising means for hinging one end of each of said arms for rotation thereof into its respective dividing member.

3. For use in dividing a substantially rigid trash receptacle having a topwardly accessible mouth defined by a rim of the receptacle into a plurality of compartments defined by a plurality of disposable trash can liners, apparatus comprising:

a peripheral support member having a lip adapted to rest on top of the rim of the receptacle with a first portion of an opening edge of each of the liners overlapping said support member and sandwiched between said support member and said rim and having a base portion adapted to abut the interior surface of the rim;

a plurality of dividing members each extending radially between an origin proximate a center of said support member and one of a plurality of connecting points spaced along said support member; and a plurality of fastener arms, one nestlable in each of said dividing members with a second portion of an opening edge of one of the liners and a third portion of an opening edge of another of the liners sandwiched therebetween;

means for hinging one end of each of said arms for rotation thereof into its respective dividing member; and means for releasably locking each of said arms within its respective dividing member;

whereby each adjacent pair of dividing members and a portion of said support member therebetween cooperate in securing an opening edge of one of the liners and to define a compartment mouth for each of the plurality of compartments.

4. Apparatus according to claim 3, said receptacle rim and said supporting member being substantially ovate.

5. Apparatus according to claim 2 further comprising means for releasably locking each of said arms within its respective dividing member.

6. Apparatus according to claim 3, said peripheral support member having a U cross-section.

7. Apparatus according to claim 3, said dividing members having a U cross-section.

8. Apparatus according to claim 7, said arms having a U cross-section nestlable within said U cross-section of said dividing members.

9. Apparatus according to claim 5, said locking means comprising at least one knurl on an interior lower edge of each of said dividing members and at least one complementary flange on an exterior edge of each of said arms adapted to be snapped over its respective knurl.

10. Apparatus according to claim 3, the receptacle having a removable receptacle cover seatable over the rim, said support member being insertable within the receptacle cover.

11. Apparatus according to claim 2, said hinging means being disposed on an end of each said arms closest to said origin.

12. Apparatus according to claim 5, said locking means comprising at least one flange on an exterior edge of another end of each of said arms and at least one complementary knurl on an interior edge of each of said dividing members, each said flange being adapted to be snapped over its respective knurl.

13. Apparatus according to claim 3, said dividing members dividing the receptacle mouth into quadrants.

14. Apparatus according to claim 3, said receptacle rim and said supporting member being circular.

15. Apparatus according to claim 3, said receptacle rim and said supporting member being substantially rectangular.

16. Apparatus according to claim 3, said receptacle rim and said supporting member being substantially square.

* * * * *